US006507125B1

(12) United States Patent
Choi

(10) Patent No.: US 6,507,125 B1
(45) Date of Patent: Jan. 14, 2003

(54) HIGH EFFICIENCY ENERGY CONVERTING APPARATUS AND METHOD THEREOF

(76) Inventor: Young Mi Choi, B1, 12-13 Seokchon-dong, Songpa-ku, Seoul (KR)

( * ) Notice: Subject to any disclaimer, the term of this patent is extended or adjusted under 35 U.S.C. 154(b) by 0 days.

(21) Appl. No.: 09/509,555

(22) PCT Filed: Jun. 11, 1999

(86) PCT No.: PCT/KR99/00289

§ 371 (c)(1),
(2), (4) Date: Apr. 14, 2000

(87) PCT Pub. No.: WO00/77460

PCT Pub. Date: Dec. 21, 2000

(51) Int. Cl.[7] ..... F25B 9/02
(52) U.S. Cl. ..... 290/1 R; 62/5
(58) Field of Search ..... 290/1 A, 1 R; 60/39

(56) References Cited

U.S. PATENT DOCUMENTS 2,519,010 A * 8/1950 Zearfoss, Jr. ..... 62/116
2,770,103 A * 11/1956 Florea ..... 62/5
2,920,457 A * 1/1960 Barlett, Jr. ..... 62/5
3,197,969 A * 8/1965 Over ..... 62/5
3,287,924 A * 11/1966 Bright ..... 62/5
3,478,528 A * 11/1969 McCully ..... 62/3.1
3,500,897 A * 3/1970 Hans-Ludwig Von Cube ..... 165/43
3,550,390 A * 12/1970 Puzniak ..... 62/5
3,553,971 A * 1/1971 Crang ..... 62/5
3,768,257 A * 10/1973 Neuffer ..... 60/269
3,982,378 A * 9/1976 Sohre ..... 60/650
4,170,116 A * 10/1979 Williams ..... 62/116
4,242,110 A * 12/1980 Hynes ..... 55/269
4,378,681 A * 4/1983 Modisette ..... 62/500
4,445,912 A * 5/1984 Volk et al. ..... 55/283
4,594,084 A * 6/1986 Lopez ..... 62/5
5,123,811 A * 6/1992 Kuroiwa ..... 415/207
5,161,365 A * 11/1992 Wright ..... 60/39.02
5,417,057 A * 5/1995 Robey ..... 60/269
5,467,613 A * 11/1995 Brasz ..... 62/402
5,682,759 A * 11/1997 Hays ..... 62/402
5,722,229 A * 3/1998 Provost ..... 60/39.07

* cited by examiner

*Primary Examiner*—Nestor Ramirez
*Assistant Examiner*—Pedro J. Cuevas
(74) *Attorney, Agent, or Firm*—Rosenberg, Klein & Lee

(57) ABSTRACT

An energy converting apparatus is disclosed which has a configuration for driving a compressor (20) by a drive force from a motor (10) to compress a fluid such as gas or liquid, generating impulse waves from the compressed fluid while forcing the compressed fluid to pass through a nozzle (30) specifically designed, and utilizing energy resulting from the impulse waves through a heat exchanger (40). The apparatus is appropriately applicable to boilers. The apparatus could provide a fuel-free boiler requiring no use of fuel other than the drive force of the motor for driving the compressor. Further, if a velocity of fluid passing through the nozzle 30 is set from Mach 1.0 to 1.5, the apparatus is also applicable to air-conditioning.

10 Claims, 2 Drawing Sheets

HIGH EFFICIENCY ENERGY CONVERTING APPARATUS AND METHOD THEREOF

TECHNICAL FIELD

The present invention relates to an energy converting apparatus and method for compressing a fluid such as gas using a compressor, and generating impulse waves from the compressed fluid while forcing the compressed fluid to pass through a nozzle, thereby achieving generation of energy. More particularly, the present invention relates to a high efficiency energy converting apparatus and method for driving a compressor by a drive force from a motor to compress a fluid, generating impulse waves from the compressed fluid while forcing the compressed fluid to pass through a nozzle specifically designed, converting kienetic energy of the comperssed fluid into heat energy, and utilizing the heat energy resulting from the impulse waves through a heat exchanger.

The present invention is appropriately applicable to boilers and air-conditioners. That is, the present invention is concerned with a high efficiency energy converting apparatus and method capable of achieving the manufacture of a fuel-free boiler or air-conditioner requiring no use of fuel other than the drive force of the motor for driving the compressor.

BACKGROUND ART

Conventional energy convertors in the form of, for example, boilers, are configured to burn fuel such as natural gas, light oil, kerosene, flaming coal, or anthracite, thereby utilizing heat generated during the burning of the fuel, or to convert electrical energy into heat energy. Among energy convertors developed heretofore, however, there is no one having a configuration capable of converting heat energy by use of impulse waves of a fluid.

The present invention is adapted to generate heat energy by use of impulse waves of compressed fluid without using any fuel other than the drive force of a motor. In accordance with the present invention, therefore, it is possible to generate a large amount of heat energy while using a reduced amount of electric power. It is also possible to completely avoid a variety of pollution occurring due to the burning of fuel. Thus, the present invention provides an epoch-making energy convertor. Since the energy convertor of the present invention makes it possible to obtain a large amount of heat energy by use of a small amount of electrical energy, it completely solves the problem in regard to exhaustion of natural fuel resources.

DISCLOSURE OF THE INVENTION

Therefore, an object of the invention is to provide a high efficiency energy converting apparatus capable of generating heat energy without using any fuel other than the drive force of a motor adapted to drive a compressor, that is, electric power, thereby completely solving problems involved in conventional boilers in regard to the use of natural fuel.

Another object of the invention is to provide a high efficiency energy converting apparatus capable of generating heat energy without using any fuel other than electric power, thereby completely avoiding a variety of pollution occurring due to the burning of fuel.

Another object of the invention is to provide a high efficiency energy converting apparatus having a simple configuration capable of achieving an easy operation, being simply applicable, as it is, to boilers and/or air-conditioners for domestic use, industrial use and other purposes.

Another object of the invention is to provide a high efficiency energy converting method in which compressed fluid is forced to pass through a multi-stage Laval nozzle, so that kinetic energy of the compressed fluid is converted into heat energy.

In accordance with the present invention, a rotating movement, namely, rotating energy, from an electric motor is transmitted to a compressor which, in turn, converts the transmitted rotating energy into kinetic energy for a fluid, thereby compressing the fluid.

In the compressing process carried out by the compressor, the fluid, which may be air, is compressed in mass to have a maximum mass. The compressed fluid is discharged from an outlet of the compressor and then fed to a single or multi-stage Laval nozzle.

The compressed fluid then passes through the Laval nozzle while bearing kinetic energy (in a normal flow and isoentropic flow fashion). At this time, if a velocity of the compressed fluid from the Laval nozzle is over Mach 1.5, vertical impulse waves are generated from the fluid in accordance with flow characteristics of the fluid. By virtue of the generated impulse waves, heat energy is generated from the fluid. That is, the kinetic energy of the fluid is converted into heat energy. As the fluid emerges from the Laval nozzle, it increases in temperature and pressure while decreasing in flow rate.

Accordingly, the fluid transfers a certain amount of heat to water to be used for heating, cleaning, or other purposes, thereby heating the heating water. Hereinafter, the water to be used for heating, cleaning, or other purposes will be referred to as "heating water". The heated heating water is supplied to a target area to be heated. After conducting a heat exchange in the target area, the fluid is still maintained at a high temperature. This hot air is then supplied to the target area via a filter in order to enhance the heating efficiency.

Further, the compressed fluid (namely, air) from the compressor then passes through a single Laval nozzle while bearing kinetic energy (in a normal flow and isentropic flow fashion). At this time, if the velocity of the compressed fluid from the Laval nozzle is set from Mach 1.0 to 1.5, as the fluid emerges from the Laval nozzle, it expands abruptly in accordance with flow characteristics of the fluid, so that it decreases greatly in temperature and pressure while accelerating the flow rate. As a result, the fluid is maintained at a low temperature. This cold fluid is then forced to flow around a cooling conduit, through which a cooling water flows, so that it cools the cooling water. Thus, the fluid is used for cooling purposes.

According to a first aspect of the present invention, it is provided an energy converting apparatus comprising: a rotating force generator for generating a rotating force in accordance with electrical energy applied thereto; compression means for compressing the mass of a fluid to a maximum compression degree in accordance with said rotating force applied thereto, thereby converting rotating energy, corresponding to the rotating force, into kinetic energy of the fluid; and impulse wave converting means comprising one or more converging-diverging nozzles connected to one another in series, the impulse wave converting means serving to generate vertical impulse waves from the compressed fluid passing through the converging-diverging nozzles, thereby converting the kinetic energy of the fluid into heat energy.

According to a second aspect of the present invention, it is provided an energy converting method comprising the steps of: applying electrical energy to an electric motor, thereby generating a rotating force; applying the rotating force to a compressor to compress the mass of a fluid to a maxium compression degree, thereby converting rotating energy, corresponding to the rotating force, into kinetic energy of the fluid; and forcing the compressed fluid to pass through one or more converging-diverging nozzles, connected to one another in series, in a normal flow and isentropic flow fashion to generate vertical impulse waves from the compressed fluid, thereby converting the kinetic energy of the fluid into heat energy.

According to a third aspect of the present invention, it is provided an energy converting method comprising the steps of: applying electrical energy to an electric motor, thereby generating a rotating force; applying the rotating force to a compressor to compress the mass of a fluid to a maxium compression degree, thereby converting rotating energy, corresponding to the rotating force, into kinetic energy of the fluid; forcing the compressed fluid to pass through at least one converging-diverging nozzle in a normal flow and isentropic flow fashion to accelerate the velocity of the fluid while decreasing said fluid in temperature and pressure, thereby cooling the fluid; and conducting a heat exchange using the cooled fluid, thereby cooling a thermal transmission medium.

Each of the converging-diverging nozzles comprises a Laval nozzle having a first uniform diameter portion having the same diameter as that of an outlet of the compression means, a first taper portion extending from the first uniform diameter portion while having a gradually decreasing diameter, a second taper portion extending from the first taper portion while having a gradually increasing diameter, and a second uniform diameter portion extending from the second taper portion while having the same diameter as that of the outlet of the compression means.

The fluid is one selected from the group consisting of air, $N_2$, Freon, and inert gas.

In accordance with the present invention in which the heating water is heated by virtue of flow characteristics of air compressed by a screw compressor, it is possible to obtain a high heat conversion efficiency corresponding to about 3.44 times that obtained in the conventional technique in which the heating water is directly heated using an electric heater.

BRIEF DESCRIPTION OF THE DRAWINGS

Other objects and aspects of the invention will become apparent from the following description of embodiments with reference to the accompanying drawings in which.

BEST MODE FOR CARRYING OUT THE INVENTION

Figure 1:
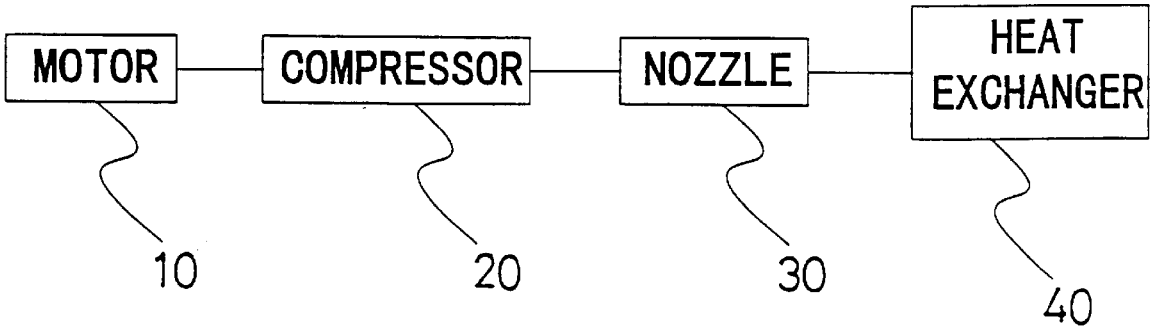
FIG. 1 is a schematic block diagram illustrating an energy converting apparatus using vertical impulse waves of a fluid in accordance with the present invention.
Figure 2:
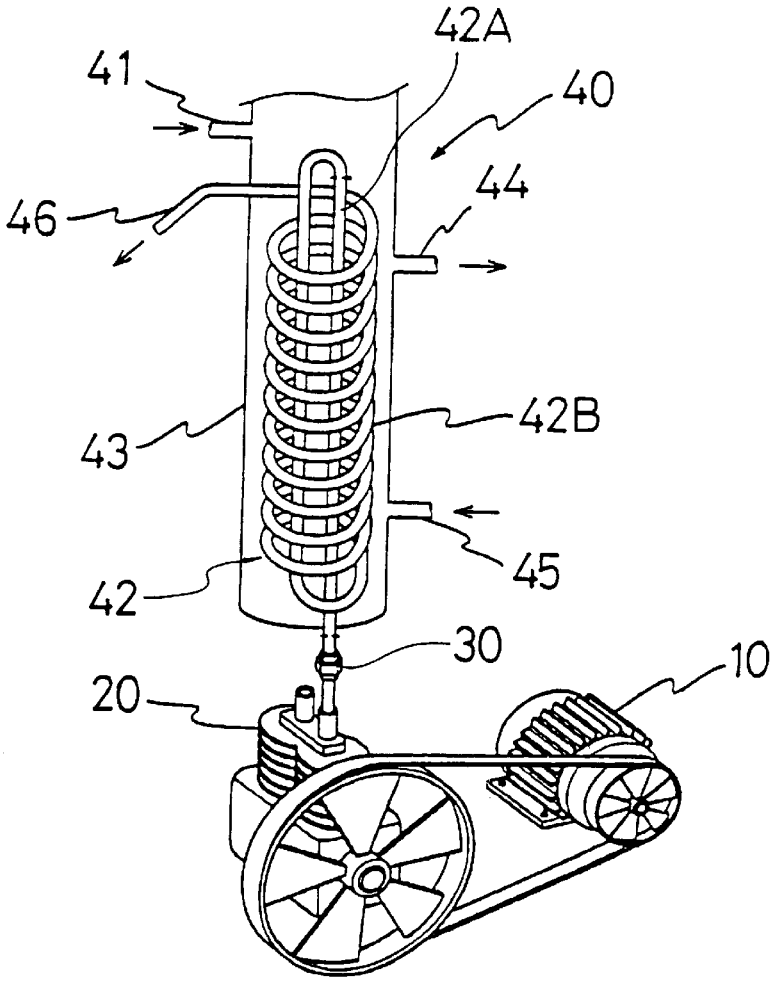
FIG. 2 is a perspective view schematically illustrating a detailed configuration of the energy converting apparatus according to an embodiment of the present invention.

FIG. 1 is a schematic block diagram illustrating an energy converting apparatus in accordance with the present invention. FIG. 2 is a perspective view schematically illustrating a detailed configuration of the energy converting apparatus according to an embodiment of the present invention.

As shown in FIGS. 1 and 2, the energy converting apparatus of the present invention includes a motor 10 driven by electric power, and a compressor 20 driven by a drive force from the motor 10. The compressor 20 serves to compress a fluid such as gas. The usable gas is one among air, $N_2$ gas, Freon gas, and inert gas.

Figure 3:
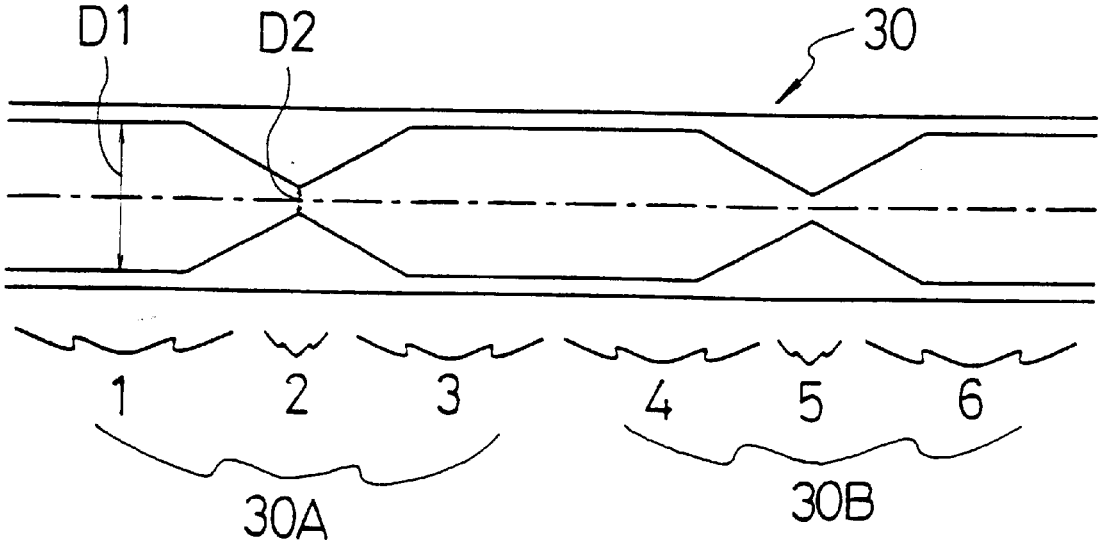
FIG. 3 is a cross-sectional view illustrating a nozzle included in the energy converting apparatus of the present invention.

The fluid compressed by the compressor 20 is forced to pass through a nozzle 30, for example, one or more converging-diverging nozzles 30A and 30B, connected to one another in series as shown in FIG. 3. The converging-diverging nozzle is called "Laval nozzle".

When the compressed fluid then passes through the converging-diverging nozzles 30A and 30B while bearing kinetic energy in a normal flow and isoentropic flow fashion. At this time, if a velocity of the compressed fluid from the converging-diverging nozzles 30A and 30B is set over Mach 1.5, vertical impulse waves are generated from the fluid in accordance with flow characteristics of the fluid.

By virtue of the generated impulse waves, heat energy is generated from the fluid. That is, the kinetic energy of the fluid is converted into heat energy. As the fluid emerges from the converging-diverging nozzles 30A and 30B, it increases in temperature and pressure while decreasing in flow rate.

The compressed fluid generates impulse waves while passing through the nozzle 30 for heat generation. The nozzle 30 is configured to generate vertical impulse waves from the compressed fluid passing therethrough by two times. As a result, a considerable amount of energy is generated.

FIG. 3 is a cross-sectional view illustrating the nozzle 30 included in the energy converting apparatus of the present invention.

As shown in FIG. 3, the nozzle 30, which is connected at its inlet to the compressor 20, mainly has six sections, that is, a first nozzle section 1, a second nozzle section 2, a third nozzle section 3, a fourth nozzle section 4, a fifth nozzle section 5, and a sixth nozzle section 6. Orifices are formed at two sections of the nozzle 30, namely, the second and fifth nozzle sections 2 and 5, respectively.

The first nozzle section 1, which is connected to a compressed fluid discharge line extending from an outlet of the compressor 20, has a uniform diameter portion extending from the compressed fluid discharge line while having the same inner diameter D1 as that of the compressed fluid discharge line, and a taper portion extending from the uniform diameter portion while having a gradually decreasing inner diameter. The second nozzle section 2 is a connection between the first and third nozzle sections 1 and 3 and forms an orifice. The third nozzle section 3 has a taper portion extending from the orifice of the second nozzle section 2 while having a gradually increasing inner diameter, and a uniform diameter portion extending from the taper portion of the third nozzle section 3 while having the same inner diameter D1 as that of the compressed fluid discharge line. The fourth nozzle section 4, which is an extension from the third nozzle section 3, has the same structure as that of the first nozzle section 1. The fifth nozzle section 5 is a connection between the fourth and sixth nozzle sections 4 and 6 and forms an orifice as in the second nozzle section 2. The sixth nozzle section 6 has the same structure as that of the third nozzle section 3.

The first to third nozzle sections 1 to 3 form a first converging-diverging nozzle 30A, and the fourth to sixth nozzle sections 4 to 6 form a second converging-diverging nozzle 30B.

Refferring to FIG. 2, a heat exchanger pipe 42 connected to the nozzle 30 includes a linear portion 42A of reverse "U" shape which extends upwardly and downwardly, after turning 180°, from the top of the water tank 43 and a coiling portion 42B which forms coil around the linear portion 42A.

The water tank 43 contains water therein. Thus, the heat exchanger pipe 42 and the water tank 43 form the heat exchanger 40. In this heat exchanger 40, heat generated from the nozzle 30 is transferred to the water contained in the water tank 43.

It will be appreciated that such a heat exchanger can be easily implemented by those skilled in the art associated with boilers. The water, which is stored in the water tank 43, is supplied from the outside through a water supply inlet 41. After being heated in the heat exchanger 40, the water from the water tank 43 is fed through a hot water outlet 44 to an area, where heating is required, or other areas requiring the heated water. After a circulation thereof, the water is returned to the interior of the heat exchanger 40 through a circulating water inlet 45. It will be appreciated that the configuration and principle for discharging the hot water through the hot water outlet 44, and returning the discharged water to the interior of the heat exchanger 40 through the circulating water inlet 45 after its circulation can be easily implemented by those skilled in the art associated with boilers.

Meanwhile, the fluid emerging from the nozzle 30 passes through the heat exchanging coil 42 and is then externally discharged. Otherwise, the fluid is introduced again into the compressor 20 so that it circulates through the compressor 20.

Figure 4:
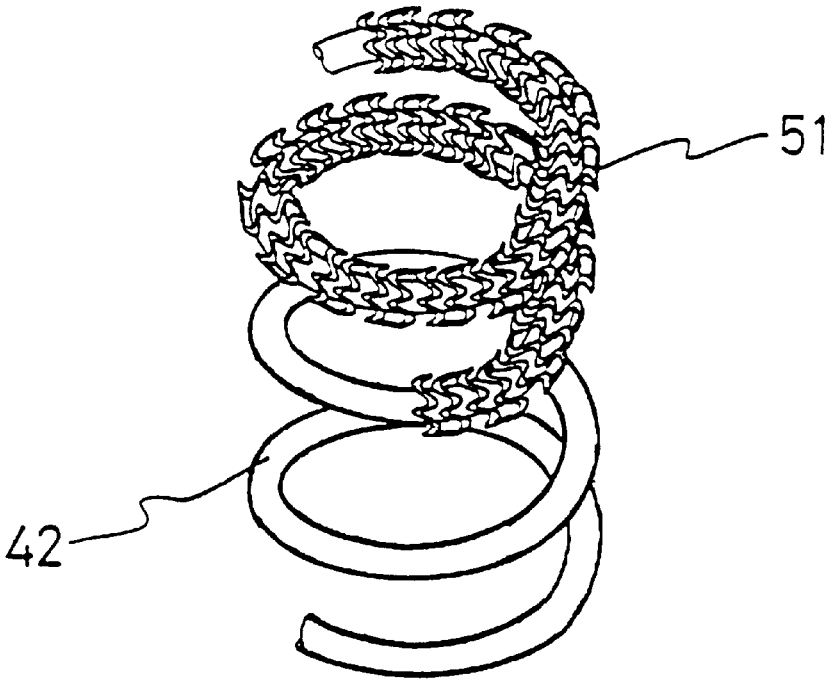
FIG. 4 is a perspective view partially illustrating a detailed construction of a heat exchanging coil used in the energy converting apparatus of the present invention.

FIG. 4 is a perspective view partially illustrating a detailed construction of the heat exchanging coil 42 used in the energy converting apparatus of the present invention. As shown in FIG. 4, the heat exchanging coil 42 is provided with heat discharge coils 51 which extend around the outer surface of the heat exchanging coil. The heat discharge coils 51 serve to efficiently transfer heat energy generated from the nozzle 30 to the water contained in the water tank 43. In order to achieve an efficient heat transfer, the heat discharge coils 51 are made of copper. Thus, the heat discharge coils 51 function as a heat transfer member.

Preferably, the orifices of the second and fifth nozzle sections 2 and 5 in the nozzle 30 have a diameter D2 of about 0.1 to 2.0 mm. Each uniform diameter portion in the nozzle 30 preferably has a diameter D1 of about 10 to 20 mm.

The fluid discharged from the compressor 20 is heated to a considerably high temperature while passing through the first nozzle section 1 of the nozzle 30, so that it bears high energy. This is because temperature and pressure of the fluid increase according to decrease in the diameter of the taper portion in the first nozzle section 1 while passing through the taper portion of the first nozzle section 1. As the fluid passes subsequently through the second nozzle section 2, it decreases slightly in temperature. The temperature of the fluid further decreases to a considerably low temperature below zero as the fluid passes through the third nozzle section 3. The fluid emerging from the third nozzle section 3 is subjected to impact again while passing through the fourth nozzle section 4. The resulting fluid exhibits an abrupt increase in temperature as it passes through the fifth nozzle section 5. The fluid emerging from the fifth nozzle section 5 further increases in temperature while passing through the sixth nozzle section 6. As a result, a large amount of energy is generated.

For the compressor 20 used in the present invention, a reciprocating compressor or a screw compressor may be used which are well known in the art. Although the reciprocating compressor has advantages in that a high compression pressure is obtained and that heat of a high temperature is obtained within a reduced period of time, its application is limited. Since the reciprocating compressor exhibits high variations in discharge amount and pressure while involving generation of noise and vibrations, it is unsuitable for domestic use, even though it is suitable for industrial use or in a case requiring a large capacity, in which those problems can be accommodated to a some degree.

On the other hand, the screw compressor is advantageous, as compared to the reciprocating compressor, in that the discharge amount and compression amount are constant and that there is no or little noise or vibrations generated. For the compressor 20 of the present invention, it is preferred that a compressor be used which has a configuration in which three strokes, that is, an intake stroke, a compression stroke, and a discharge stroke, are repeatedly carried out in accordance with the actions of a piston, a cylinder, and a cam.

Although the compressor 20 discharges air in a high temperature and pressure state, this air decreases abruptly in temperature and pressure when it is outwardly discharged from the compressor 20 to, for example, the atmosphere or a tank. In such circumstances, the air discharged from the compressor 20 is useless, except for applications simply using compressed air. In order to obtain heat energy from the air discharged from the compressor 20, therefore, it is necessary to recover the discharged air to its state obtained in the compressor 20, that is, its high temperature and pressure state. To this end, the nozzle 30 is installed between the compressor 20 and heat exchanger 40 in accordance with the present invention. The nozzle 30 serves to recover the air discharged from the compressor 20 to a high temperature and pressure state approximate to the original state obtained in the compressor 20 by virtue of flow characteristics of the air exhibited as the air passes through the nozzle 30.

Since the discharged air exhibits a subsonic velocity (Mach<1), it is accelerated to a supersonic velocity (Mach>1.5) using the first converging-diverging nozzle 30A such as a Laval nozzle in accordance with the present invention. The resultant air accelerated to a supersonic velocity is then forced to pass through the second converging-diverging nozzle 30B. As the air passes through the second converging-diverging nozzle 30B, it generates vertical impulse waves, so that it is recovered in terms of pressure and temperature. In the nozzle, the air flow is compressed after generating impulse waves. The compressed air emerging from the nozzle 30 at a reduced velocity is discharged into the heat exchanger 40 (air or water tank) so that it is used for heat exchange, namely, heating.

In addition, in the first converging-diverging nozzle 30A, if a velocity of air passing through orifice 2 is set from Mach 1.0 to Mach 1.5, the compressed air emerging from the nozzle 30A is accelerated, not reduced in velocity and does not generates any vertical impulse waves. As the air emerges from the orifice 2 of the nozzle 30A, it expands abruptly, so that it decrease in temperature and pressure while increasing flow rate.

As a result, the air is maintained at a low temperature. This cold air is then forced to flow around a cooling conduit, through which a cooling water flows, so that it cools the cooling water. Thus, the air of low temperature is used for cooling purposes.

In order to evaluate the energy converting apparatus according to the present invention, the following example is made. Of course, this example is made only for illustrative purposes, and those skilled in the art will appreciate that various modifications, additions and substitutions are possible, without departing from the scope and spirit of the invention. Accordingly, the present invention is not to be construed as being limited to this example.

EXAMPLE

In this example, the above mentioned energy converting apparatus having a configuration according to the present invention was used to heat an area of 30 pyong (1 pyong= 3.954 sq. yds.).

For the motor of the energy converting apparatus, an electric motor of 1 HP (R.P.M. 1,730; and 60 KHz) was used. In accordance with the International Standard, the power consumption of this motor is 0.75 kw/h (1 kw=860 kcal). That is, the motor consumes 645 kcal per hour while rotating by electric power. The rotation of the motor is converted into a piston reciprocation of the compressor included in the energy converting apparatus. The power conversion efficiency, namely, the efficiency of power transmission from the motor to the compressor, ranges from 75% to 85% even though it depends on the power transmission method used. The power transmission may be carried out in a belt transmission fashion or in a direct transmission fashion. Taking into consideration this power transmission efficiency, the rotation efficiency and heat value efficiency of the motor can be expressed as follows:

$$1)\ \text{Rotation Efficiency} = 1{,}730 \times 0.95 \times 0.85 = 1{,}396.975 \approx 1{,}397\ \text{R.P.M.}$$

$$2)\ \text{Heat Efficiency} = 645 \times 0.95 \times 0.85 = 520.83 \approx 521\ \text{kcal}$$

That is, the motor generates about 1,397 R.P.M and heat of 521 kcal while consuming 0.75 kw per hour. The heat of 521 kcal generated per hour by the motor (using electric power of 0.75 kw) is a theoretical value according to the law of thermodynamical energy conservation whereas the above mentioned heat value of 645 kcal is a heat value experimentally obtained. Accordingly, the motor of 1 HP consumes 0.75 kw (=645 kcal) per hour, so that it can transmit working energy of only 645 kcal to the compressor.

In order to heat the area of 30 pyong, the motor of 1 HP was driven 7 times per hour. The drive time of this motor per time was 3 minutes and 20 seconds. The total drive time of the motor per day and the total power consumption based on the total drive time can be derived as follows:

3 min and 20 sec×7=23 min and 20 sec (per hour)

23 min×24=9.2 hr (per day)

9.2×0.75 kw=6.9 kw

Since the total power consumption of the motor per day is 6.9 kw, the total power consumption per month is 207 kw (=6.9 kw×30). Assuming that the rates of electricity for domestic use are 177.7 Won ("Won" is the monetary standard in Korea) per kw, based on a power consumption of 400 kw per month, and that at least 400 kw per month including the power consumption of the motor is consumed, the electricity rates per month taken to heat the area of 30 pyong are 36,783.90 Won (=207×177.7 Won).

In the compressor, its piston conducts a straight reciprocation in accordance with a movement of a crank shaft receiving the rotation of the motor. The compressor has a mechanical efficiency of about 0.75 to 0.85%, taking into consideration a frictional loss resulting from the reciprocation and a rotational loss resulting from the movement of the crank shaft. Accordingly, the crank R.P.M. and piston speed of the compressor in an idle state can be derived as follows:

$$1)\ \text{Crank R.P.M.} = 1{,}397 \times 0.85 = 1{,}187.45 \approx 1{,}187\ \text{R.P.M.}$$

$$2)\ \text{Piston Speed} = 1{,}187 \times 2(\text{2 cylinder type}) \approx 2{,}374\ \text{times/min}$$

The cylinders used had a diameter of 5.495 cm and a cross-sectional area of 0.00237 $m^2$ whereas the stroke length of the piston was 18 cm. Under these conditions, the intake volume of each cylinder is 0.00043 $m^3$ at the atmospheric pressure. Accordingly, the total intake volume of the compressor per minute can be derived as follows:

$$0.00043\ m^3 \times 2 = 0.00086\ m^3\ (0.86\ l)$$

$$0.86\ l \times 2{,}734\ \text{times/min} = 2{,}041.64\ l/\text{min}$$

That is, the total intake volume of the compressor per minute is about 2,042 l.

As apparent from the following expression, 1 kg of atmospheric air has a volume $V_m$ of 773 l.

$$V_m = R \times T / P = 287 \times 273 / (1.0132 \times 10^5) = 0.7733 \approx 773\ l$$

Therefore, the air intake amount of the compressor designed as mentioned above corresponds to 2.64 kg (=2,042/773). Since the discharge mass is equal to the intake mass in accordance with the law of mass conservation, the discharge amount of compressed air per min corresponds to 2.64 kg. The specific heat of air is 0.31, based on the specific heat of water being 1. Air also has a specific heat ratio corresponding to 1.4. The temperature $T_2$ of air exhibited after the compression of the air can be expressed as follows:

$$T_2 = T_1 (P_2/P_1)^{k-1/k}$$

where, $T_1$: Ambient Temperature;

$P_2$: Compression Pressure;

$P_1$: Atmospheric Pressure; and k: Specific Heat Ratio of Air

Accordingly, the temperature T2 can be derived as follows:

$$T2 = 288 \times (10\ \text{bar}/1.0132)^{0.2857} = 533.94°\ \text{K} \approx 534°\ \text{K}\ (= 281°\ \text{C.})$$

After 1 kg of air is compressed to 10 bar, it has a heat value Q derived as follows:

$$Q = 1.0045\ (Cp) \times (T2 - T1)$$

$$= 1.0045 \times (534 - 288) = 247.107\ KJ$$

247.107 KJ=59 kcal (1 kcal=4.1868 J)

Assuming that the amount of heating water required to heat an area of 30 pyong is 13 l and that the heating water is to be heated to 80° C. for its heating purpose, the heat required to heat the above amount of heating water, every time the area is to be heated, is 1,040 kcal (=13×80). In this case, accordingly, air of 17,62 kg (1,040/59) is required.

In order to compress the above amount of air, it is necessary to drive the compressor for 6 minutes and 40 seconds because the compression mass of the compressor is 2.64 kg (17.62/2.64=6.67 min=6 min and 40 sec). In this example, however, the same result was obtained within a drive time of 3 minutes and 20 seconds corresponding to 50% of the theoretical drive time. That is, the same amount of water was heated to a desired temperature (80° C.) within 3 minutes and 20 seconds. This is because the energy converting apparatus of the present invention is designed to utilize heat energy resulting from friction occurring in the nozzle and compressor.

Although it is difficult to convert heat energy into working energy in accordance with the law of thermodynamics, working energy can be completely converted into heat energy, as apparent from the above experimental value. The heat transmitted from the motor to the compressor was 10.75 kcal per min (645 kcal/h÷60 min=10.75) whereas the total heat value of air per min converted into heat energy by virtue of friction resulting from kinetic energy obtained in accordance with the characteristics of air, namely, the specif heat of air corresponding to 0.31, was 155.76 kcal. Thus, it was found that a high thermal conversion efficiency is obtained using a reduced power consumption.

INDUSTRIAL APPLICABILITY

As apparent from the above description, the present invention completely solves problems involved in the use of natural fuel because it generates heat energy by use of impulse waves of compressed fluid without using any fuel other than the drive force of a motor, that is, electrical energy, to drive a compressor. It is also possible to completely avoid a variety of pollution occurring due to the burning of fuel. Since the high efficiency energy converting apparatus of the present invention has a simple configuration capable of achieving an easy operation, it can be simply applicable, as it is, to boilers for domestic use, industrial use and other purposes.

In addition, according as the velocity of fluid passing through orifice of the nozzle is appropriately set, cold fluid can be obtained. Therefore, the present invention is also applicable to air-conditioning equipment.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An energy converting apparatus comprising:

a rotating force generator for generating a rotating force in accordance with electrical energy applied thereto;

compression means for compressing the mass of a fluid to a maximum compression degree in accordance with said rotating force applied thereto, thereby converting rotating energy, corresponding to said rotating force, into kinetic energy of said fluid; and impulse wave converting means comprising one or more converging-diverging nozzles connected to one another in series, said impulse wave converting means serving to generate vertical impulse waves from said compressed fluid passing through said converging-diverging nozzles, thereby converting said kinetic energy of said fluid into heat energy, each of said converging-diverging nozzles comprising a Laval nozzle having (a) a first uniform diameter portion having a diameter equal to a diameter of an outlet of said compression means, (b) a first taper portion extending from said first uniform diameter portion and having a gradually decreasing diameter, (c) a second taper portion extending from said first taper portion and having a gradually increasing diameter, and (d) a second uniform diameter portion extending from said second taper portion and having a diameter equal to said diameter of said outlet of said compression means.

2. The energy converting apparatus as claimed in claim 1, wherein a velocity of the compressed fluid passing through an orifice between the first and second taper portions is over Mach 1.5.

3. The energy converting apparatus as claimed in claim 1, wherein said compressed fluid passes through said converging-diverging nozzles in a normal flow and isentropic flow fashion.

4. The energy converting apparatus as claimed in claim 1, further comprising:

a heat exchanger for conducting a heat exchange of said heat energy with water, and circulating the resultant heated water through a heating conduit.

5. The energy converting apparatus as claimed in claim 1, 2, 3, or 4, wherein said fluid is one selected from the group consisting of air, $N_2$, Freon, and inert gas.

6. An energy converting method comprising the steps of:

applying electrical energy to an electric motor to thereby generate a rotating force;

applying said rotating force to a compressor to compress a mass of a fluid to a maximum compression degree, thereby converting rotating energy corresponding to said rotating force into kinetic energy of said fluid; and forcing said compressed fluid to pass through one or more Laval nozzles connected to one another in series, each of said Laval nozzles having (a) a first uniform diameter portion having a diameter equal to a diameter of an outlet of said compressor, (b) a first taper portion extending from said first uniform diameter portion and having a gradually decreasing diameter, (c) a second taper portion extending from said first taper portion and having a gradually increasing diameter, and (d) a second uniform diameter portion extending from said second taper portion and having a diameter equal to said diameter of said outlet of said compressor, said compressed fluid passing in a normal flow and isentropic flow fashion to generate vertical impulse waves from said compressed fluid, thereby converting said kinetic energy of said fluid into heat energy.

7. The energy converting method as claimed in claim 6, further comprising the step of:

conducting a heat exchange of said heat energy with water in a heat exchange; and circulating the resultant heated water through a heating conduit.

8. An energy converting method comprising the steps of:

applying electrical energy to an electric motor to thereby generate a rotating force;

applying said rotating force to a compressor to compress a mass of a fluid to a maximum compression degree, thereby converting rotating energy corresponding to said rotating force into kinetic energy of said fluid;

forcing said compressed fluid to pass through at least one Laval nozzle having (a) a first uniform diameter portion having a diameter equal to a diameter of an outlet of said compressor, (b) a first taper portion extending from said first uniform diameter portion and having a gradually decreasing diameter, (c) a second taper portion extending from said first taper portion and having a gradually increasing diameter, and (d) a second uniform diameter portion extending from said second taper portion and having a diameter equal to said diameter of said outlet of said compressor, said compressed fluid passing in a normal flow and isentropic flow fashion to accelerate a velocity of said fluid while decreasing a temperature and pressure of said fluid, thereby cooling said fluid; and conducting a heat exchange using said cooled fluid, thereby cooling a thermal transmission medium.

9. The energy converting method as claimed in claim 8, wherein said fluid is one selected from the group consisting of air, $N_2$, Freon, and inert gas.

10. The energy converting method as claimed in claim 8, wherein a velocity of the fluid passing through the nozzle is set from Mach 1.0 to Mach 1.5.

* * * * *